US007311572B2

(12) United States Patent
Yamashita et al.

(10) Patent No.: US 7,311,572 B2
(45) Date of Patent: Dec. 25, 2007

(54) OUTBOARD MOTOR STEERING CONTROL SYSTEM

(75) Inventors: Kosei Yamashita, Saitama (JP); Hiroshi Mizuguchi, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/509,467

(22) Filed: Aug. 24, 2006

(65) Prior Publication Data

US 2007/0066157 A1 Mar. 22, 2007

(30) Foreign Application Priority Data

Sep. 22, 2005 (JP) ..... 2005-276145

(51) Int. Cl.
*B63H 20/08* (2006.01)

(52) U.S. Cl. ..... 440/63; 440/60

(58) Field of Classification Search ..... 440/60, 440/62, 63, 53; 114/159
See application file for complete search history.

(56) References Cited

U.S. PATENT DOCUMENTS 6,561,860 B2 * 5/2003 Colyvas ..... 440/63
6,913,497 B1 * 7/2005 Ahlswede et al. ..... 440/63

FOREIGN PATENT DOCUMENTS

JP 404038297 * 2/1992
JP 2004-052697 2/2004

* cited by examiner

*Primary Examiner*—Ed Swinehart
(74) *Attorney, Agent, or Firm*—Carrier, Blackman & Associates P.C.; Joseph P. Carrier; William D. Blackman

(57) ABSTRACT

In an outboard motor steering control system having a plurality of outboard motors each mounted on a stern of a boat by a shaft to be movable by an outboard motor actuator relative to the boat and each having an internal combustion engine and a propeller powered by the engine to propel the boat, a tie-bar motor (actuator) is operated such that the outboard motors can be finely operated synchronously to make desired steering angles finely, i.e., to achieve the desired steering angles in response to a detected rotation angle of a steering wheel. Also outboard motor actuators are individually operated to regulate the relative angles between the outboard motors, thereby enhancing both straight course-holding performance and turning performance.

8 Claims, 14 Drawing Sheets

FIG. 8

| θsw | -540 | -360 | -180 | -5 | 0 | 5 | 180 | 360 | 540 |
|---|---|---|---|---|---|---|---|---|---|
| θdr | -30.0 | -20.0 | -10.0 | -0.3 | 0 | 0.3 | 10.0 | 20.0 | 30.0 |
| θdl | -30.0 | -20.0 | -10.0 | -0.3 | 0 | 0.3 | 10.0 | 20.0 | 30.0 |
| θdl-θdr | 0 | 0 | 0 | 0 | 0 | 0 | 0 | 0 | 0 |

UNIT [° ]

FIG. 10

| θsw | −540 | −360 | −180 | −5 | 0 | 5 | 180 | 360 | 540 |
|---|---|---|---|---|---|---|---|---|---|
| θdra | +0.8 | +0.8 | +0.8 | 0 | −0.4 | 0 | 0 | 0 | 0 |
| θdla | 0 | 0 | 0 | 0 | 0.4 | 0 | −0.8 | −0.8 | −0.8 |
| θdr+θdra | −29.2 | −19.2 | −9.2 | −0.3 | −0.4 | 0.3 | 10.0 | 20.0 | 30.0 |
| θdl+θdla | −30.0 | −20.0 | −10.0 | −0.3 | 0.4 | 0.3 | 9.2 | 19.2 | 29.2 |

UNIT [° ]

OUTBOARD MOTOR STEERING CONTROL SYSTEM

BACKGROUND OF THE INVENTION

1. Field of the Invention

This invention relates to an outboard motor steering control system, particularly to an outboard motor steering control system for controlling steering of multiple outboard motors.

2. Description of the Related Art

Conventionally, boats are commonly equipped with two or more outboard motors mounted side-by-side in what is called a "multiple outboard motor installation," as disclosed, for example, in Japanese Laid-Open Patent Application No. 2004-52697 (particularly paragraphs 0014 to 0016, FIG. 1). In addition, outboard motor steering control systems are proposed in recent years in which actuators are installed to operate the multiple outboard motors separately or individually.

In the case of multiple outboard motor installation, the straight course-holding performance or turning performance of boat can be improved by giving the outboard motors different steering angles in response to the cruising conditions so as to regulate their relative angles. To be more specific, straight course-holding performance can be improved by establishing the relative angles so that extensions of the propeller shafts intersect forward of the outboard motors in the direction of forward travel, thereby enabling to restrain the lateral fluctuation of the boat.

Turning performance also can be improved by making the extensions of the propeller shafts intersect rearward of the outboard motors in the direction of forward travel, when an absolute value of rotation angle of the steering wheel equal to or greater than a predetermined value, i.e., when the boat is controlled to make a relatively great turn. In other cruising conditions, for instance, when an absolute value of rotational angle of the steering wheel is less than a predetermined value (i.e., when the boat is controlled to make a relatively small turn), the outboard motors are steered synchronously by making the extensions of the propeller shafts parallel to each other, in other words, setting their relative angles to zero.

When actuators are installed to operate multiple outboard motors separately or individually, however, it is difficult to make control to steer the outboard motors synchronously to achieve desired relative angles therebetween, resulting in insufficient steering performance.

SUMMARY OF THE INVENTION

An object of this invention is therefore to overcome this problem by providing an outboard motor steering control system that improves steering performance by operating multiple boat-mounted outboard motors synchronously to make desired steering angles and enhances both straight course-holding performance and turning performance by regulating the relative angles between the multiple boat-mounted outboard motors.

In order to achieve the object, this invention provides a system for controlling steering of a plurality of outboard motors each mounted on a stern of a boat to be steerable by an outboard motor actuator relative to the boat and each having an internal combustion engine and a propeller powered by the engine to propel the boat, comprising: a tie bar interconnecting the outboard motors; a tie-bar actuator adapted to drive the tie bar; a rotation angle sensor adapted to detect a rotation angle of a steering wheel installed at a cockpit of the boat; a tie-bar actuator controller adapted to control operation of the tie-bar actuator based on the detected rotation angle of the steering wheel.

BRIEF DESCRIPTION OF THE DRAWINGS

The above and other objects and advantages of the invention will be more apparent from the following description and drawings in which:

FIG. 8 is a table showing some specific numerical values in degrees taken from the characteristics shown in FIG. 7;

FIG. 10 is a table similar to FIG. 8 showing some specific numerical values in degrees taken from the characteristics of mapped data used in the flowchart of FIG. 9;

DETAILED DESCRIPTION OF THE PREFERRED EMBODIMENT

An outboard motor steering control system according to a preferred embodiment of this invention will now be explained with reference to the attached drawings.

Figure 1:
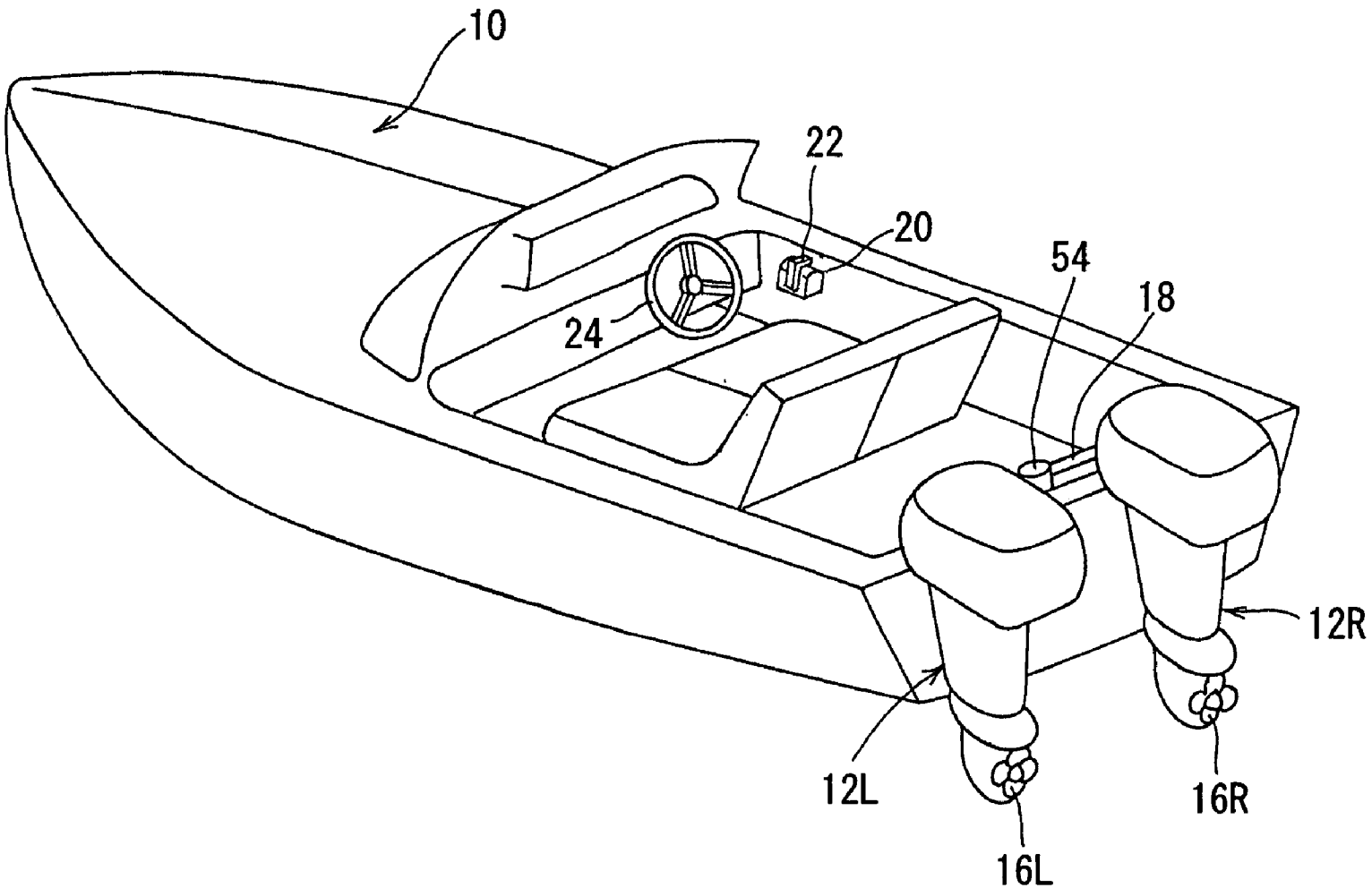
FIG. 1 is a schematic view showing a boat and outboard motors to which the outboard motor steering control system according to the embodiment of the invention is installed.

FIG. 1 is a schematic view showing a boat and outboard motors to which the outboard motor steering control system according to the embodiment of the invention is installed.

As shown in FIG. 1, a plurality of, more precisely two outboard motors are mounted on the stern of a boat or hull 10. In other words, the boat 10 has what is known as a multiple or dual outboard motor installation. In the following, the starboard side outboard motor, i.e., outboard motor on the right side when looking in the direction of forward travel is called the "starboard outboard motor" and assigned the reference symbol 12R. The port side outboard motor, i.e., outboard motor on the left side when looking in the direction of forward travel is called the "port outboard motor" and assigned the reference symbol 12L.

The starboard and port outboard motors 12R, 12L are equipped with propellers 16R, 16L and internal combustion engines (hereinafter simply called "engines"; not shown in FIG. 1). The propellers 16R, 16L are rotated by power transmitted from the engines and produce thrust for propelling the boat 10. The starboard and port outboard motors 12R, 12L are interconnected by a tie bar (tie rod) 18 (explained later).

A remote control box 20 is installed near a cockpit or operator's seat of the boat 10. The remote control box 20 is equipped with a lever 22 to be operable by the operator. The lever 22 can be rotated fore and aft, i.e., toward and away from the operator from its initial position, by which the operator can input shift (gear) position commands and engine speed regulation commands. A steering wheel 24 is also installed near the cockpit to be rotatably manipulated. The operator can rotate the steering wheel 24 to input steering or turning commands.

Figure 2:
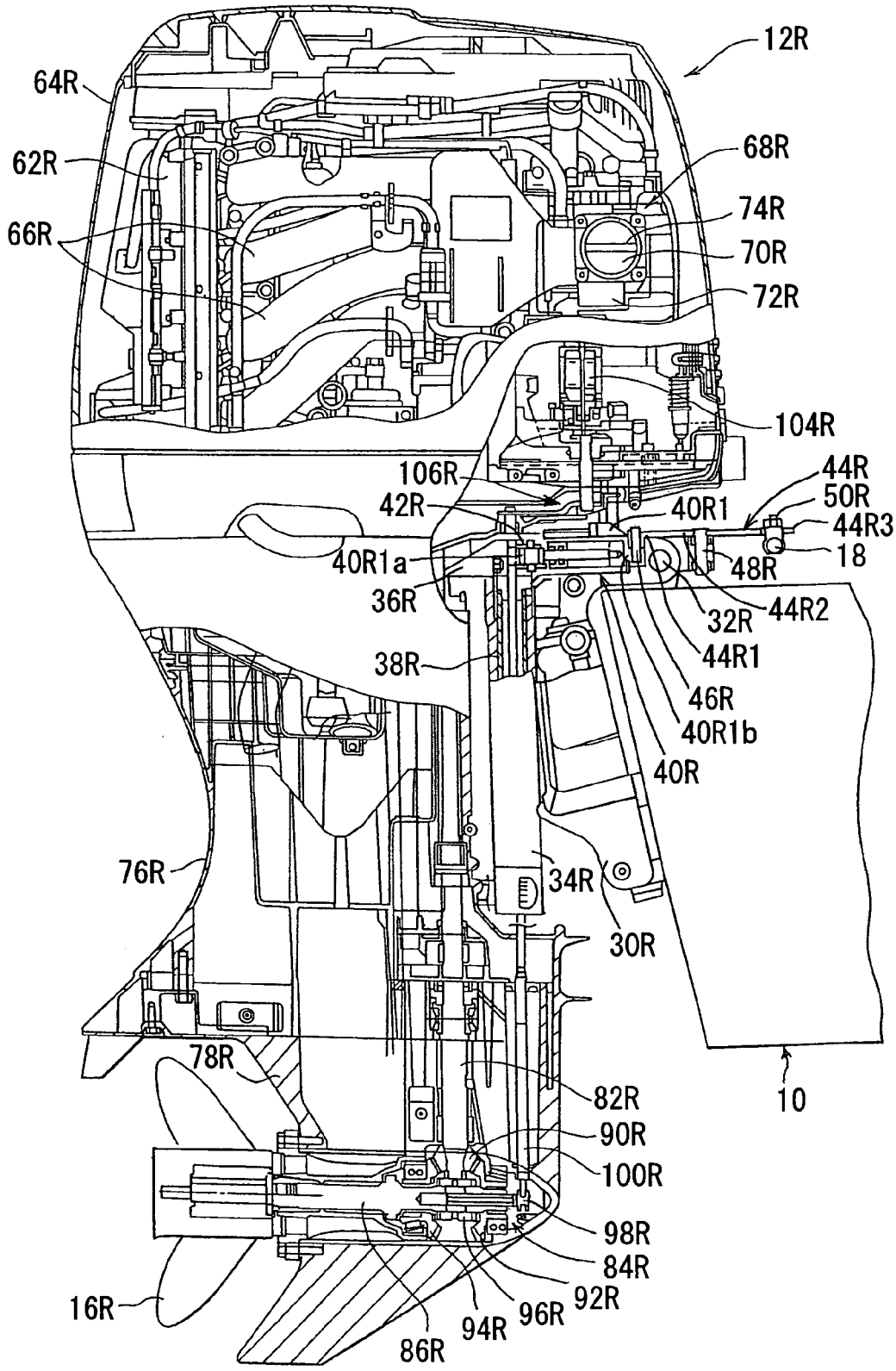
FIG. 2 is an enlarged sectional side view showing the region of a starboard outboard motor shown in FIG. 1.

FIG. 2 is an enlarged sectional side view showing the region of the starboard outboard motor 12R shown in FIG. 1. The structure of the starboard outboard motor 12R will be explained with reference to FIG. 2. Since the configurations of the starboard outboard motor 12R and port outboard motor 12L are the same, the following explanation is also applied to the port outboard motor 12L. Components of the port outboard motor 12L will be assigned by "L" instead of "R" that is appended to the reference symbols of components of the starboard outboard motor 12R.

As shown in FIG. 2, the starboard outboard motor 12R is equipped with stem brackets 30R fastened to the stem of the boat 10. A swivel case 34R is attached to the stern brackets 30R through a tilting shaft 32R.

The shaft 38R of a mount frame 36R is housed in the swivel case 34R to be freely rotated about a vertical axis. The upper end of the mount frame 36R and lower end thereof, i.e., lower end of the shaft 38R, are fastened to a frame (not shown) constituting a main body of the starboard outboard motor 12R.

Figure 3:
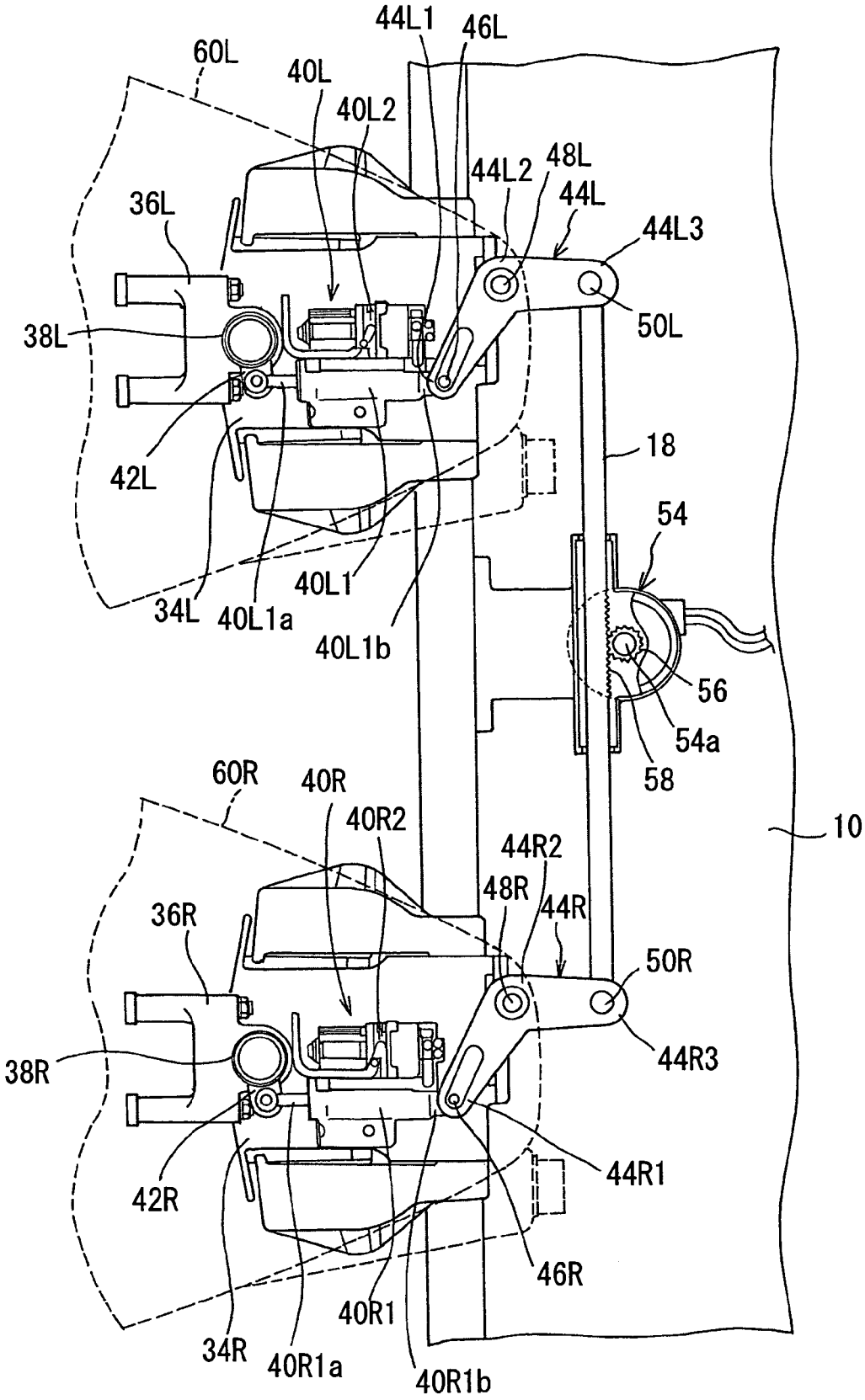
FIG. 3 is a plan view showing the region around swivel cases of the starboard outboard motor and a port outboard motor shown in FIG. 1 as viewed from the top.

FIG. 3 is a plan view showing the region around the swivel cases 34R, 34L of the starboard and port outboard motors 12R, 12L as viewed from the top.

As shown in FIGS. 2 and 3, the upper portion of the swivel case 34R is installed with an outboard motor actuator 40R. The outboard motor actuator 40R is equipped with a hydraulic cylinder 40R1 constituted of a double-acting cylinder, and a hydraulic pump 40R2 (not shown in FIG. 2) that is connected to the cylinder 40R1 to supply hydraulic pressure thereto.

The cylinder 40R1 is attached at its rod head 40R1*a* to the mount frame 36R through a stay 42R. When the pump 40R2 is operated to drive, i.e., extend and contract the cylinder 40R1, it makes the shaft 38R rotate to steer the starboard outboard motor 12R. Specifically, the cylinder 40R1 is driven in the extension direction such that the shaft 38R and mount frame 36R are rotated clockwise when viewed from the top relative to the boat 10, thereby steering the starboard outboard motor 12R clockwise. On the other hand, the cylinder 40R1 is driven in the contraction direction such that the shaft 38R and mount frame 36R are rotated counterclockwise relative to the boat 10, thereby steering the starboard outboard motor 12R counterclockwise.

The cylinder bottom 40R1*b* of the cylinder 40R1 is movably connected to one end 44R1 of a link 44R through a first connecting pin 46R. The link 44R is formed with a curvature section 44R2 that is curving viewed in a plane. The curvature section 44R2 is connected via a second connecting pin 48R to the swivel case 34R to be freely rotated about the vertical axis.

The other end 44R3 of the link 44R is connected via a third connecting pin 50R to the tie bar 18 to be freely rotated. Thus the other end 44R3 of the link 44R of the starboard outboard motor 12R and the other end 44L3 of a link 44L of the port outboard motor 12L are interconnected, i.e., the starboard outboard motor 12R and port outboard motor 12L are interconnected by the tie bar 18.

As shown in FIG. 3, an electric tie-bar motor (actuator) 54 that drives the tie bar 18 is installed rearward of the boat 10 and near the center of the tie bar 18. The output shaft (not shown) of the tie-bar motor 54 is connected to the rotational axis 54*a* through a speed reduction gear mechanism (not shown). A pinion gear 56 is disposed onto the outer periphery of the rotating shaft 54*a*.

A rack gear 58 that meshes with the pinion gear 56 is formed near the center of the tie bar 18. The rotation of the rotating shaft 54*a* of the tie-bar motor 54 operates the tie bar 18 to the right and left directions in the traveling direction, so that the starboard and port outboard motors 12R, 12L are steered.

The steering operation of the starboard and port outboard motors 12R, 12L by the tie-bar motor 54 will be explained briefly by exemplifying the case that the starboard and port outboard motors 12R, 12L are steered counterclockwise by the tie bar motor 54.

Figure 4:
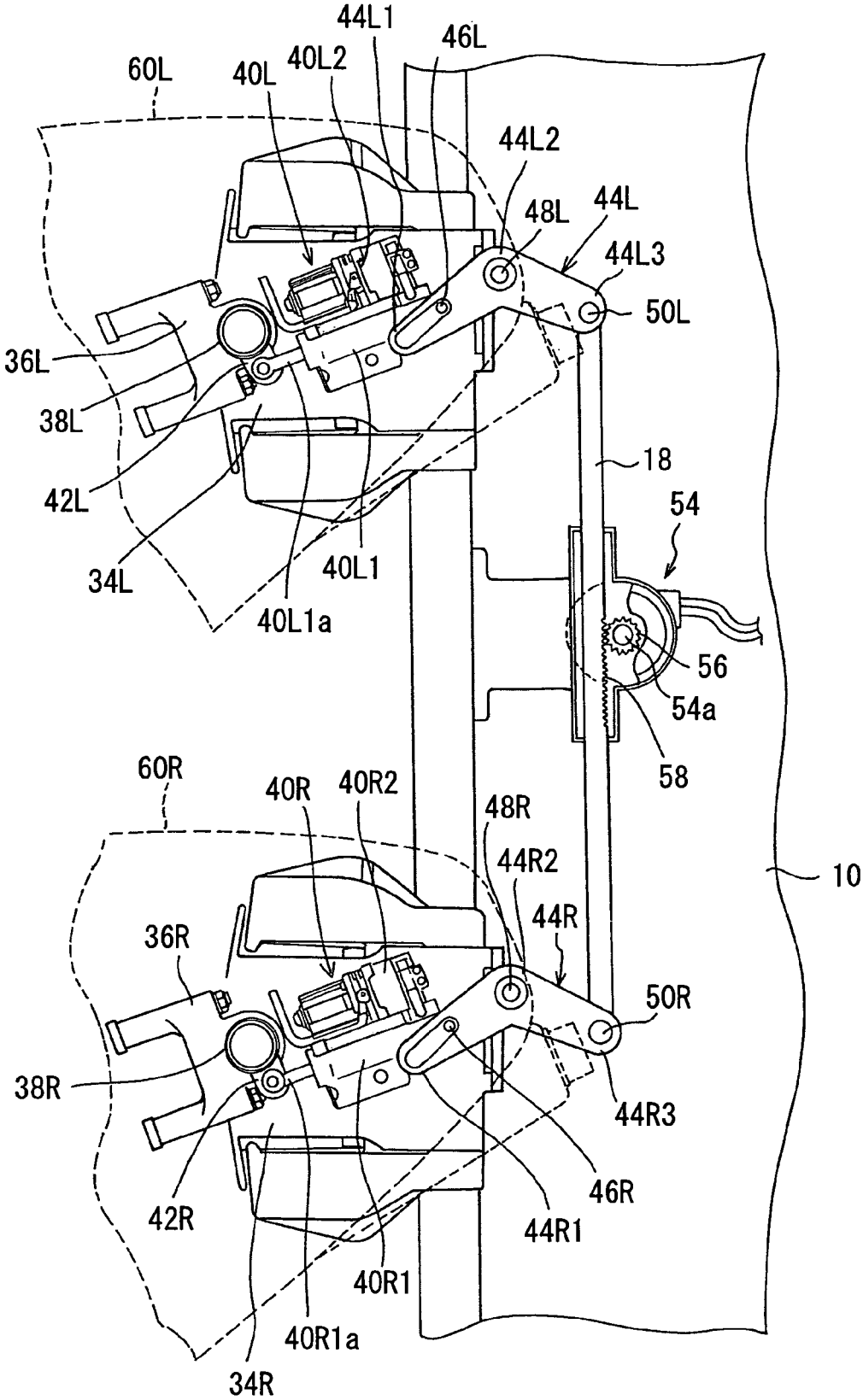
FIG. 4 is a plan view similar to FIG. 3 showing the region around the swivel cases as viewed from the top when the starboard and port outboard motors shown in FIG. 1 are steered counterclockwise.

The counterclockwise rotation of the rotating shaft 54*a* of the tie-bar motor 54 replaces the tie bar 18 to the right in the traveling direction, as shown in FIG. 4. With this, the links 44R, 44L are rotated clockwise about the second connecting pins 48R, 48L, so that the outboard motor actuators 40R, 40L, shafts 38R, 38L and mount frames 36R, 36L are rotated counterclockwise with respect to the boat 10, thereby steering the starboard and port outboard motors 12R, 12L counterclockwise.

Due to the interconnection between the outboard motors 12R, 12L by the tie bar 18, the starboard and port outboard motors 12R, 12L can be steered synchronously. In FIGS. 3 and 4, reference symbols 60R, 60L indicate the visible outline (vertical plane of projection) of the starboard and port outboard motors 12R, 12L as viewed from the top.

Although not illustrated, when the rotating shaft 54*a* of the tie-bar motor 54 is rotated clockwise, contrary to the foregoing operation, the starboard and port outboard motors 12R, 12L are steered clockwise.

Thus the starboard and port outboard motors 12R, 12L comprise the outboard motor actuators 40R, 40L that operate the outboard motors 12R, 12L separately or individually, and the tie-bar motor 54 that steers the starboard and port outboard motors 12R, 12L synchronously.

The explanation of FIG. 2 will be resumed. The starboard outboard motor 12R is equipped with an engine 62R at its upper portion. The engine 62R comprises a spark-ignition gasoline engine with a displacement of 2,200 cc. The engine 62R is located above the water surface and covered by an engine cover 64R.

The engine 62R has an intake pipe 66R that is connected to a throttle body 68R. The throttle body 68R is equipped with a throttle valve 70R and an electric throttle motor 72R that drives the throttle valve 70R. The output shaft of the throttle motor 72R is connected via a speed reduction gear mechanism (not shown) with a throttle shaft 74R that rotatably supports the throttle valve 70R. Specifically, a rotational output generated by driving the throttle motor 72R is transmitted to the throttle shaft 74R to open and close the throttle valve 70R, thereby regulating air sucked in the engine 62R to control the engine speed.

An extension case 76R is installed at the lower portion of the engine cover 64R and a gear case 78R is installed at the lower portion of the extension case 76R. A drive shaft (vertical shaft) 82R is supported in the extension case 76R and gear case 78R to be freely rotated about the vertical axis. One end, i.e., the upper end of the drive shaft 82R is connected to a crankshaft (not shown) of the engine 62R and the other end, i.e., the lower end thereof is connected to a propeller shaft 86R via a shift mechanism 84R.

A propeller shaft 86R is supported in the gear case 78R to be freely rotated about the horizontal axis. One end of the propeller shaft 86R extends from the gear case 78R toward the rear of the starboard outboard motor 12R and the propeller 16R is attached thereto, i.e., the one end of the propeller shaft 86R.

The shift mechanism 84R comprises a pinion gear 90R installed at the lower end of the drive shaft 82R, a forward bevel gear 92R and reverse bevel gear 94R that are disposed onto the outer periphery of the propeller shaft 86R to be rotatable in opposite directions by engagement with the pinion gear 90R, a shift clutch 96R that is installed between the forward bevel gear 92R and reverse bevel gear 94R and is rotated integrally with the propeller shaft 86R, and a shift rod 100R that is connected to the shift clutch 96R through a shift slider 98R.

The interior of the engine cover 64R is disposed with an electric shift motor 104R that drives the shift mechanism 84R to change the gear position. The output shaft of the shift motor 104R is connected to the upper end of the shift rod 100R through a speed reduction gear mechanism 106R. Therefore, when the shift motor 104R is driven, its rotational output is transmitted to the shift rod 100R through the speed reduction gear mechanism 106R, thereby sliding the shift clutch 96R to change the direction of rotation of the propeller shaft 86R and switch the shift position among forward, reverse and neutral positions.

Based on the foregoing explanation, the outboard motor steering control system will now be explained.

Figure 5:
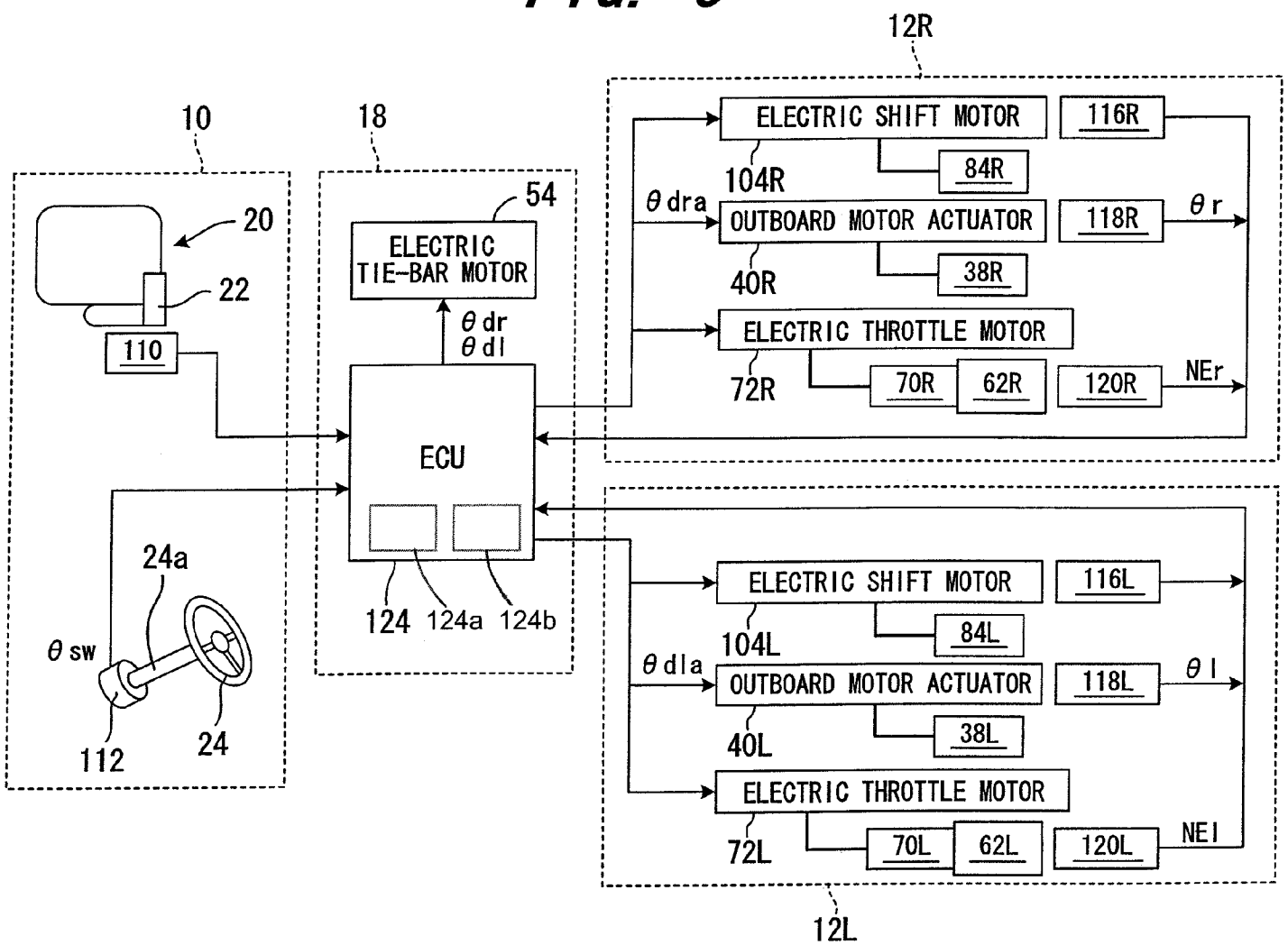
FIG. 5 is a block diagram showing the outboard motor steering control system shown in FIG. 1.

FIG. 5 is a block diagram showing the outboard motor steering control system.

As shown in FIG. 5, a lever position sensor 110 is provided near the lever 22 of the remote control box 20 installed on the boat 10. The lever position sensor 110 produces an output or signal corresponding to the position to which the lever 22 is manipulated by the operator. A rotation angle sensor 112 is provided on the rotating shaft 24*a* of the steering wheel 24. The rotation angle sensor 112 produces an output or signal proportional to the rotation angle θsw of the steering wheel 24 manipulated by the operator.

Shift position sensors 116R, 116L are installed near the shift motors 104R, 104L of the outboard motors. The shift position sensors 116R, 116L produce outputs or signals in response to the output rotation angle, i.e., shift (gear) position, of the shift motors 104R, 104L. Steering angle sensors 118R, 118L are provided near the shafts 38R, 38L that are the steering shafts of the outboard motors. The steering angle sensors 118R, 118L produce outputs or signals in response to the steering angle θr of the starboard outboard motor and steering angle θl of the port outboard motor. Further, crank angle sensors 120R, 120L are installed near the crankshafts (not shown) of the engines 62R, 62L mounted on the outboard motors. The crank angle sensors 120R, 120L output the pulse signals at every predetermined crank angle (e.g., 30 degrees).

The outputs of the foregoing sensors are inputted to an electronic control unit (ECU) 124. The ECU 124 comprises a microcomputer equipped with an input/output circuit, CPU and the other components (none of which shown) and is disposed at an appropriate position near the tie bar 18.

Based on the output of the lever position sensor 110, more exactly, the manipulated direction of the lever 22 determined from the output value, the ECU 124 controls the operation of the shift motors 104R, 104L of the outboard motors to operate the shift mechanisms 90R, 90L, thereby changing a shift (gear) position. The ECU 124 also determines whether the shift change has been completed or finished based on the outputs of the shift position sensors 116R, 116L and, when the completion is determined, terminates the operation of the shift motors 104R, 104L. It also controls the operation of the throttle motors 72R, 72L based on the output of the lever position sensor 110, more exactly, the magnitude of the output value to regulate the engine speed.

The ECU 124 counts the output signals of the crank angle sensors 120R, 120L to calculate or detect speed NEr, NEl of the engines 62R, 62L. The ECU 124 also determines desired steering angles θdr, θdl of the outboard motors 12R, 12L respectively based on the rotation angle θsw of the steering wheel 24 and controls the operation of the tie-bar motor 54 to steer the outboard motors 12R, 12L individually on the basis of the determined desired steering angles θdr, θdl, specifically, such that the detected steering angles θr, θl become desired steering angles θdr, θdl.

Furthermore, based on the engine speed NEr, NEl, the rotation angle θsw of the steering wheel 24 and the outputs of the shift position sensors 116R, 116L, the ECU 124 determines desired regulation steering angles θdra, θdla of the outboard motors 12R, 12L respectively, and based on the determined desired regulation steering angles θdra, θdla, it controls the operation of the outboard motor actuators 40R, 40L to steer the outboard motors 12R, 12L individually.

It should be noted that the total rotation angle of the steering wheel 24 is 1080 degrees in this embodiment. Specifically, the lock-to-lock of the steering wheel 24 is set to be 3 revolutions and the steering wheel 24 can be freely rotated by 540 degrees to each of right and left directions. The total steering angle of each outboard motor 12R, 12L is set to be 60 degrees. Specifically, the outboard motors 12R, 12L are freely steered by 30 degrees to each of right and left directions from the neutral position.

As explained, the ECU 124 controls the operation of the tie-bar motor 54, outboard motor actuators 40R, 40L and the like.

The control of the operation of the tie-bar motor 54 and outboard motor actuators 40R, 40L will now be explained with focus on the determination of the desired steering angles θdr, θdl and desired regulation steering angles θdra, θdla.

Figure 6:
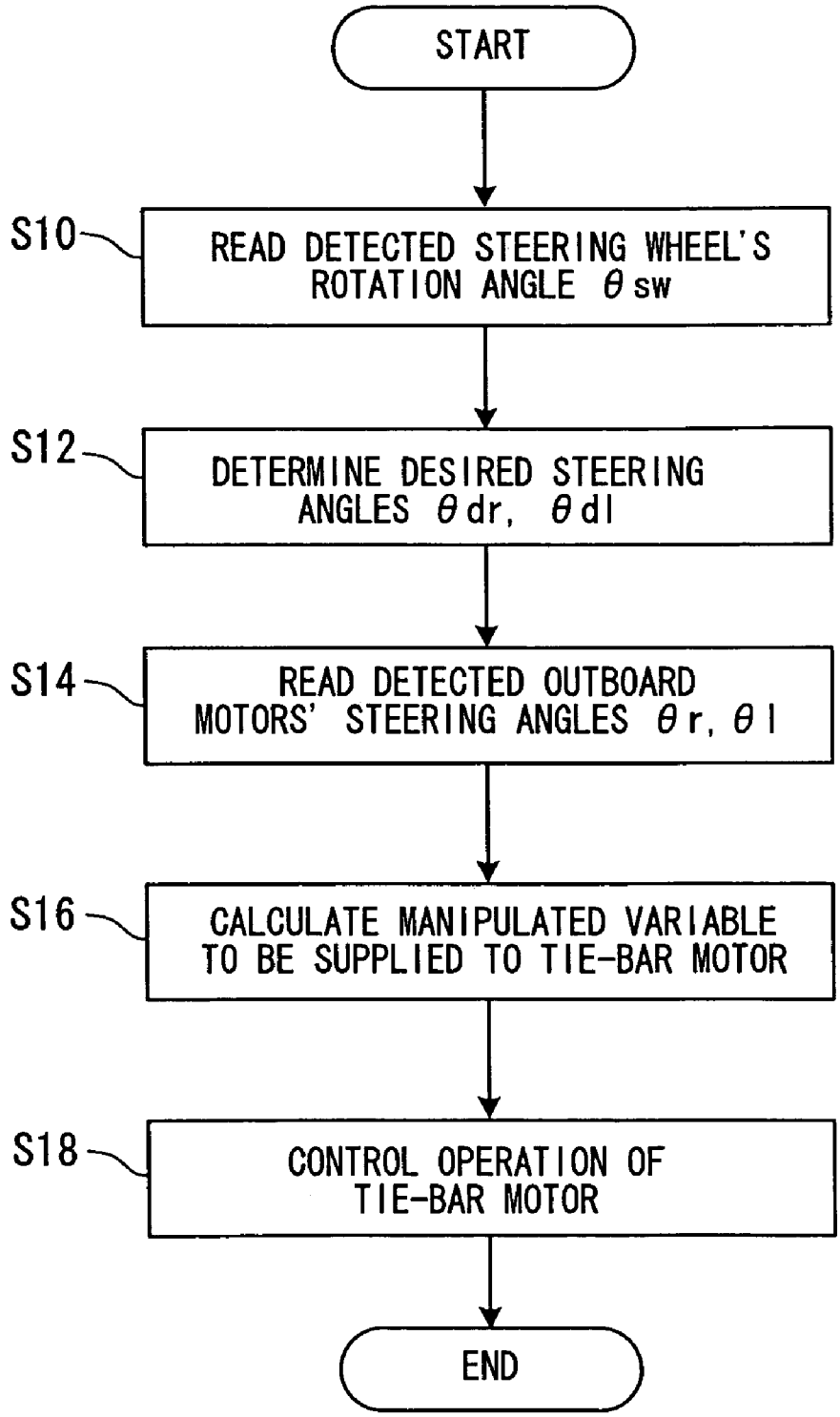
FIG. 6 is a flowchart showing the flow of processing for controlling a tie-bar motor shown in FIG. 5.

FIG. 6 is a flowchart showing the flow of processing for controlling the tie-bar motor 54. The ECU 124 executes this routine at predetermined intervals (e.g., every 10 milliseconds).

First, in S10, the rotation angle θsw of the steering wheel 24 detected by the rotation angle sensor 112 is read. Next, in S12, the desired steering angles θdr, θdl of the outboard motors 12R, 12L are determined based on the rotation angle θsw of the steering wheel.

Mapped data representing the relationship between the desired steering angles θdr, θdl and the rotation angle θsw of the steering wheel are stored in a RAM (not shown) of the ECU 124. In S12, the mapped data are used to retrieve values of the desired steering angles θdr, θdl proportional to the rotation angle θsw.

Figure 7:
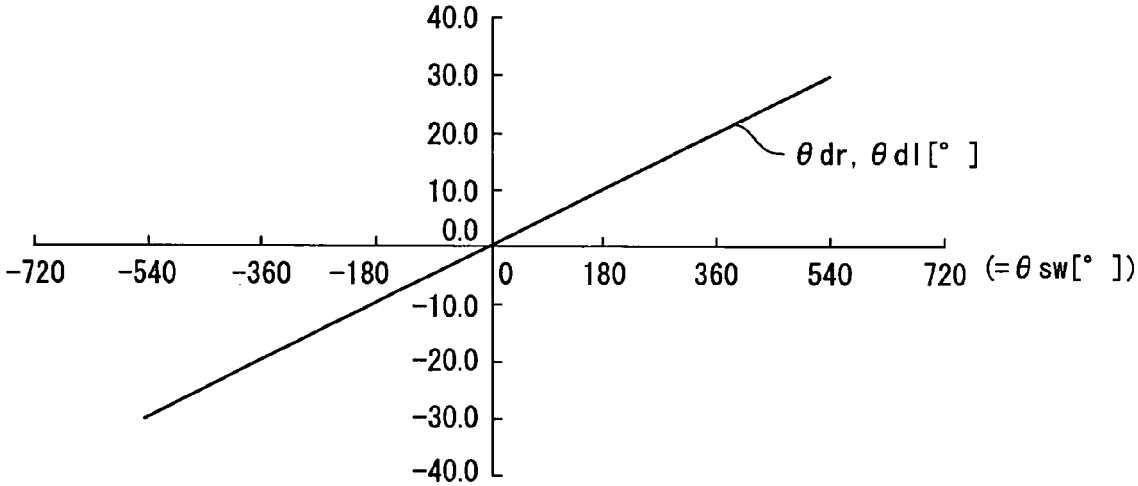
FIG. 7 is a graph representing the characteristics of mapped data used in the flowchart of FIG. 6.

FIG. 7 is a graph representing the characteristics of the foregoing mapped data and FIG. 8 is a table showing some specific numerical values in degrees taken from the characteristics shown in FIG. 7, i.e., characteristics of the desired steering angles θdr, θdl against the rotation angle θsw. In this embodiment, the steering direction when the outboard motors 12R, 12L are rotated clockwise as viewed from the top, i.e., when the propellers 16R, 16L move from right to left as viewed from behind is defined as positive. The direction of rotation of the steering wheel 24 when the outboard motors 12R, 12L are rotated clockwise is defined as positive.

As shown in FIGS. 7 and 8, the desired steering angle θdr of the starboard outboard motor 12R and the desired steering angle θdl of the port outboard motor 12L are set or determined to the same value (i.e., the difference between θdr and θdl is made 0).

The explanation of FIG. 6 will be resumed. The program goes to S14, in which the steering angle θr of the starboard outboard motor 12R and steering angle θl of the port outboard motor 12L detected by the steering angle sensors 118R, 118L are read. Next, in S16, the manipulated variable or control input to be supplied to the tie-bar motor 54 is calculated. The manipulated variable is determined so as to eliminate the error between the desired values θdr, θdl and the detected values θr, θl of the steering angles. Then, in S18, the operation of the tie-bar motor 54 is controlled based on the calculated manipulated variable, thereby independently steering the outboard motors 12R, 12L.

Thus, owing to the tie-bar motor 54, the starboard outboard motor 12R and port outboard motor 12L can be operated synchronously, while the extension of the propeller shaft 86R of the starboard outboard motor 12R and that of the propeller shaft 86L of the port outboard motor 12L can be held in parallel with each other regardless of the steering wheel rotation angle θsw.

The control of the operation of the outboard motor actuators 40R, 40L will now be explained with focus on the determination of the desired regulation steering angles θdra, θdla.

Figure 9:
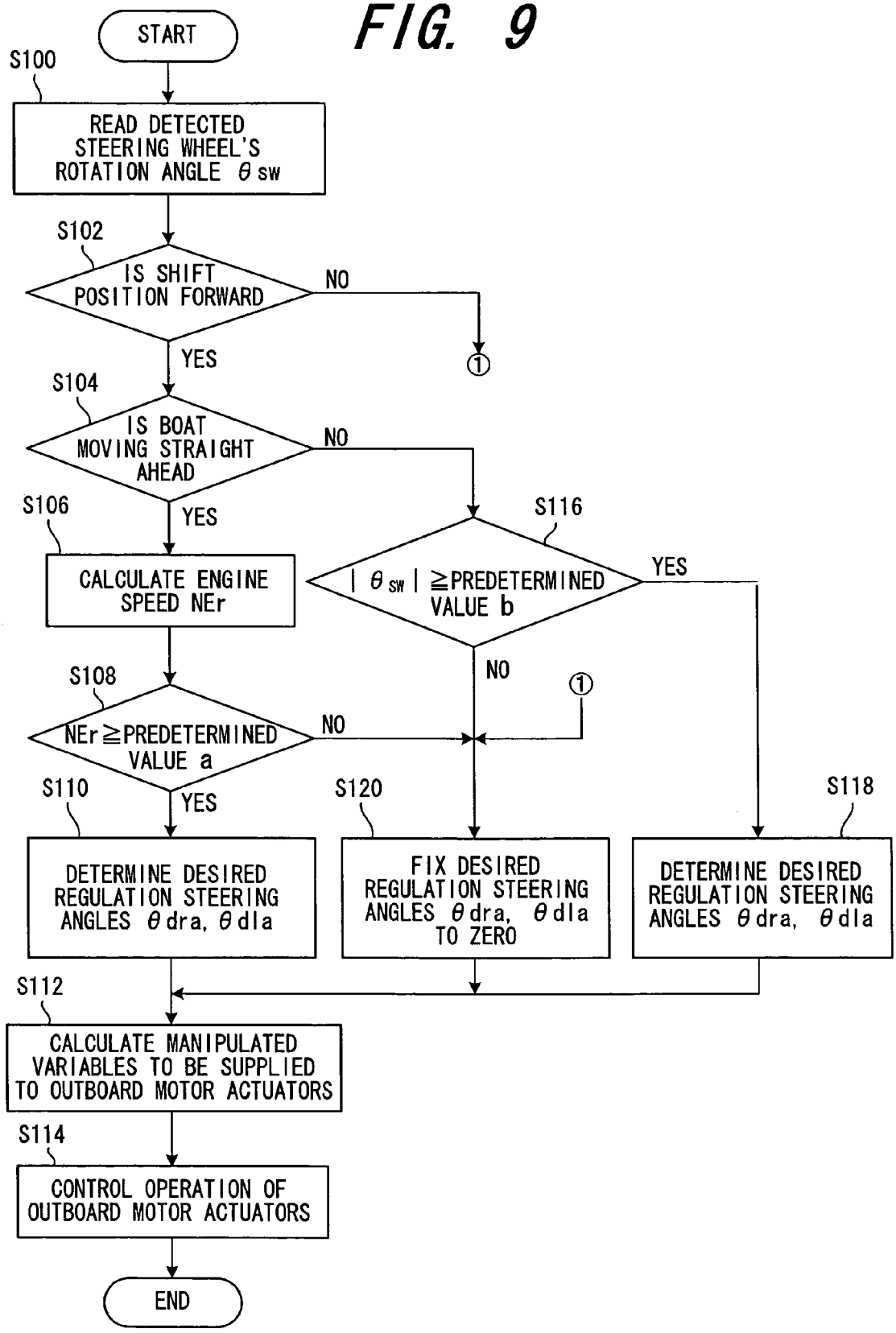
FIG. 9 is a flowchart showing the flow of processing for controlling the operation of outboard motor actuators shown in FIG. 5.

FIG. 9 is a flowchart showing the flow of processing for controlling the operation of the outboard motor actuators 40R, 40L. The ECU 124 executes this routine at predetermined intervals (e.g., every 10 milliseconds).

First, in S100, the rotation angle θsw of the steering wheel 24 detected by the rotation angle sensor 112 is read. Next, in S102, it is determined whether the shift (gear) position is forward. The determination in S102 is made by referring to the outputs of the shift position sensors 116R, 116L of the outboard motors or the output of the lever position sensor 110.

When the result in S102 is YES, the program goes to S104, in which it is determined whether or not the boat 10 is moving straight ahead. The determination in S104 is made by determining whether the rotation angle θsw detected in S100 is zero degree or substantially zero degree.

When the result in S104 is YES, i.e., it is determined that the boat 10 is moving straight ahead, the program goes to S106, in which the engine speed NEr of the starboard outboard motor 12R is calculated. Next, in S108, it is determined whether the engine speed NEr is equal to or greater than a predetermined value a (e.g., 2000 rpm).

When the result in S108 is YES, i.e., it is determined that the engine speed NEr is equal to or greater than the predetermined value a in other words, when it is estimated that the boat speed is medium or higher than medium, the program goes to S110, in which the desired regulation steering angles θdra, θdla of the starboard and port outboard motors 12R, 12L are determined based on the rotation angle θsw of the steering wheel 24 and the engine speed NEr.

Mapped data representing the relationship between the desired regulation steering angles θdra, θdla and the steering wheel rotation angle θsw and engine speed NEr are stored in the RAM of the ECU 124. In S110, the mapped data are used to retrieve values of the desired regulation steering angles θdra, θdla.

FIG. 10 is a table similar to FIG. 8 showing some specific numerical values in degrees taken from the characteristics of the mapped data.

As shown in FIG. 10, when the rotation angle θsw is 0 degree, the desired regulation steering angles θdra, θdla are defined such that the steering angles θr, θl of the starboard and port outboard motors 12R, 12L are assigned with different values. When the rotation angle θsw is 0 degree (when the operator wants to go straight ahead), the desired regulation steering angles θdra, θdla are assigned with the same absolute value but made opposite in sign. Specifically, θdra is made −0.4 degree and θdla is made 0.4 degree.

The explanation of FIG. 9 will be resumed. The program goes to S112, in which the manipulated variables or control inputs to be supplied to the outboard motor actuators 40R, 40L are calculated. The manipulated variables are determined in response to the desired regulation steering angles θdra, θdla. Next, in S114, the operation of the outboard motor actuators 40R, 40L is controlled in accordance with the calculated manipulated variables, thereby regulating the relative angle between the starboard and port outboard motors 12R, 12L.

Figure 11:
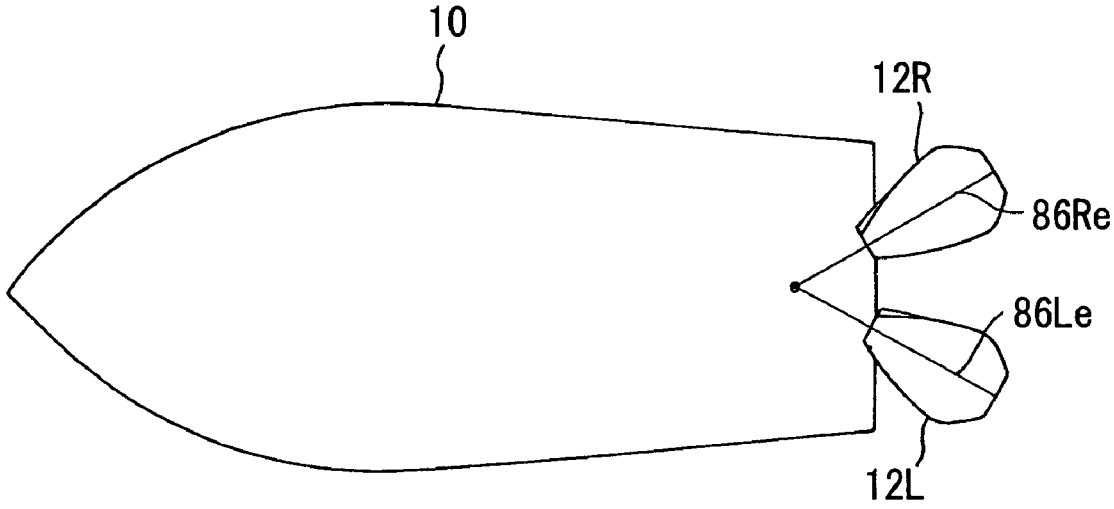
FIG. 11 is an explanatory view showing the relative angle between the starboard and port outboard motors shown in FIG. 1.
Figure 12:
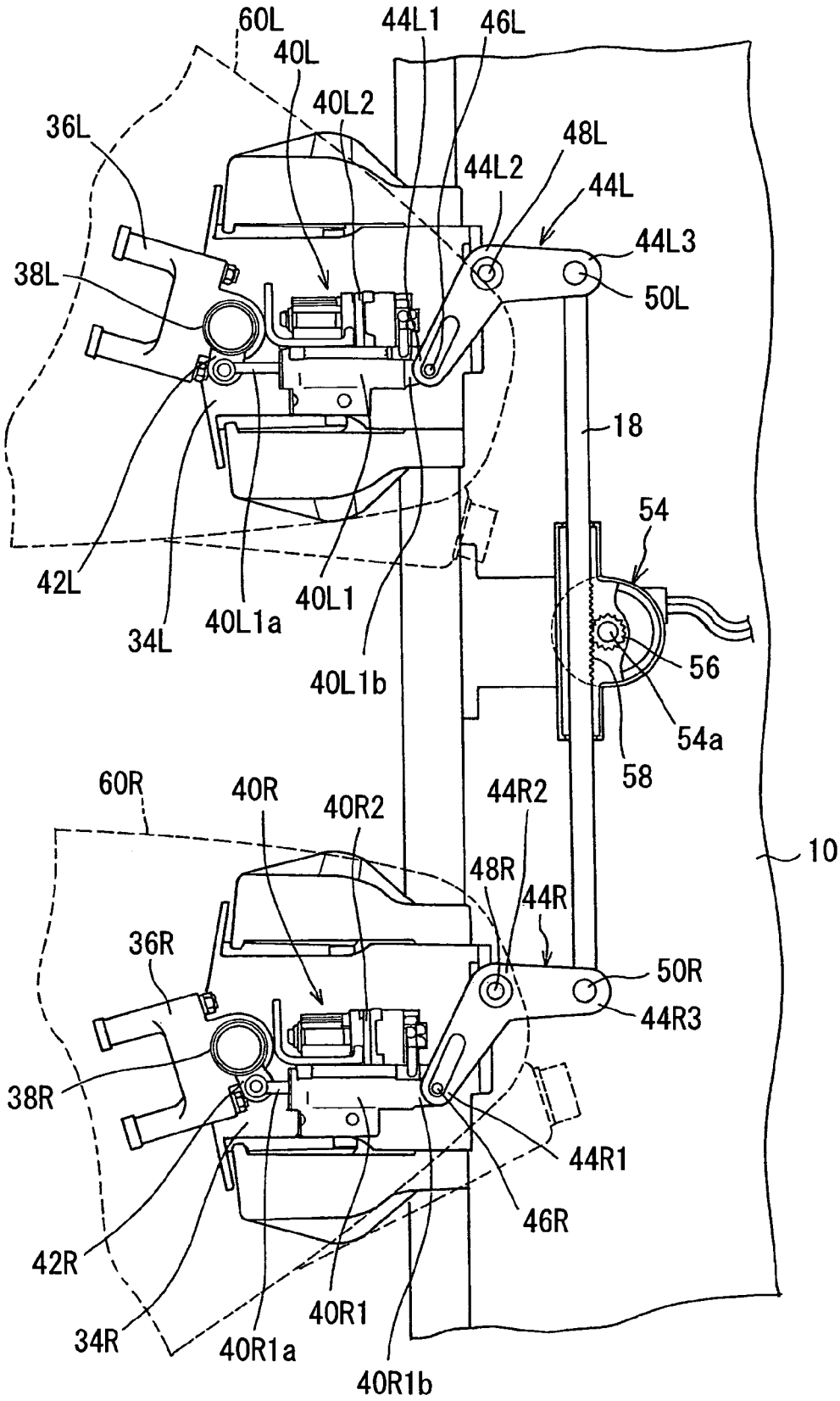
FIG. 12 is a plan view similar to FIG. 3 showing the region around the swivel cases of the starboard and port outboard motors shown in FIG. 1 as viewed from the top.

FIG. 11 is an explanatory view showing the relative angle between the starboard outboard motor 12R and port outboard motor 12L. FIG. 12 is a plan view similar to FIG. 3 showing the region around the swivel cases 34R, 34L of the starboard and port outboard motors 12R, 12L as viewed from the top.

As shown in FIGS. 11 and 12, the setting of θdra to −0.4 degree steers the starboard outboard motor 12R counterclockwise by the outboard motor actuator 40R. On the other hand, the setting of θdla to 0.4 degree steers the port outboard motor 12L clockwise by the outboard motor actuator 40L. As shown in FIG. 12, since the rotation angle θsw is 0 degree, the tie-bar motor 54 is not operated.

As a result, as shown in FIG. 11, the extension of the propeller shaft 86R of the starboard outboard motor (designated 86Re) and the extension of the propeller shaft 86L of the port outboard motor (designated 86Le) are made to intersect forward of the outboard motors 12R, 12L in the traveling direction, as viewed in a plane. This condition is referred to as "toe-in" and the difference at this time is referred to as the "toe-in angle." The toe-in angle is exaggerated in FIGS. 11 and 12 to make it easy to recognize.

The explanation of FIG. 9 will be continued. When the result in S104 is NO, i.e., it is determined that the boat 10 is turning, the program goes to S116, in which it is determined whether an absolute value of the rotation angle θsw is equal to or greater than a predetermined value b, specifically 180 degrees.

When the result in S116 is YES, i.e., it is determined that turn of the boat 10 is relatively large, the program goes to S118, in which, similarly to S110, the desired regulation steering angles θdra, θdla of the starboard and port outboard motors 12R, 12L are determined using the mapped data shown in FIG. 10. Specifically, when the rotation angle θsw is equal to or greater than 180 degrees, the desired regulation steering angle θdra is made 0 degree and θdla −0.8 degree. On the other hand, when the rotation angle θsw is equal to or less than −180 degrees, the desired regulation steering angle θdra is made 0.8 degree and θdla 0 degree. Next, in S112 and S114, the aforesaid processing is conducted.

Figure 13:
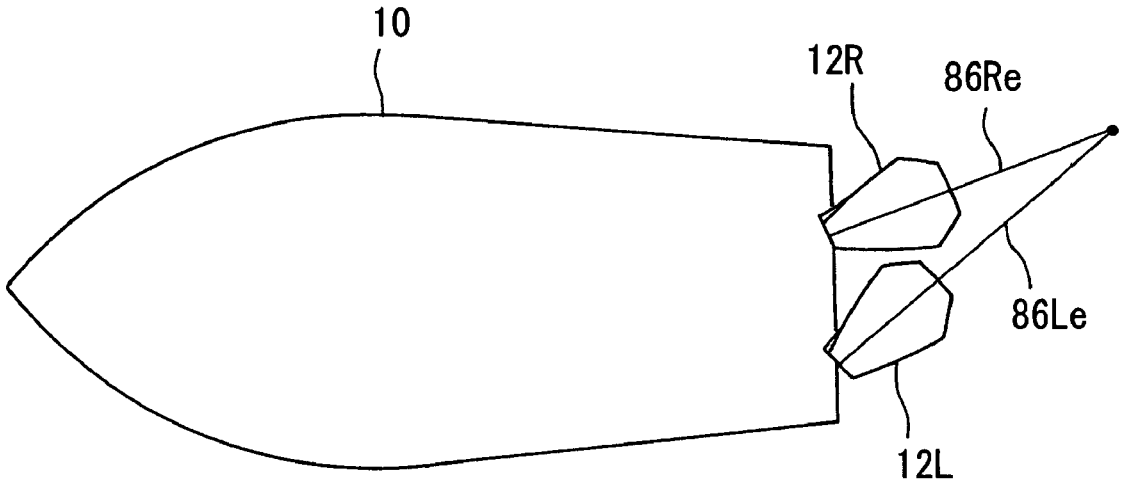
FIG. 13 is an explanatory view similar to FIG. 11 showing the relative angle between the starboard and port outboard motors shown in FIG. 1.
Figure 14:
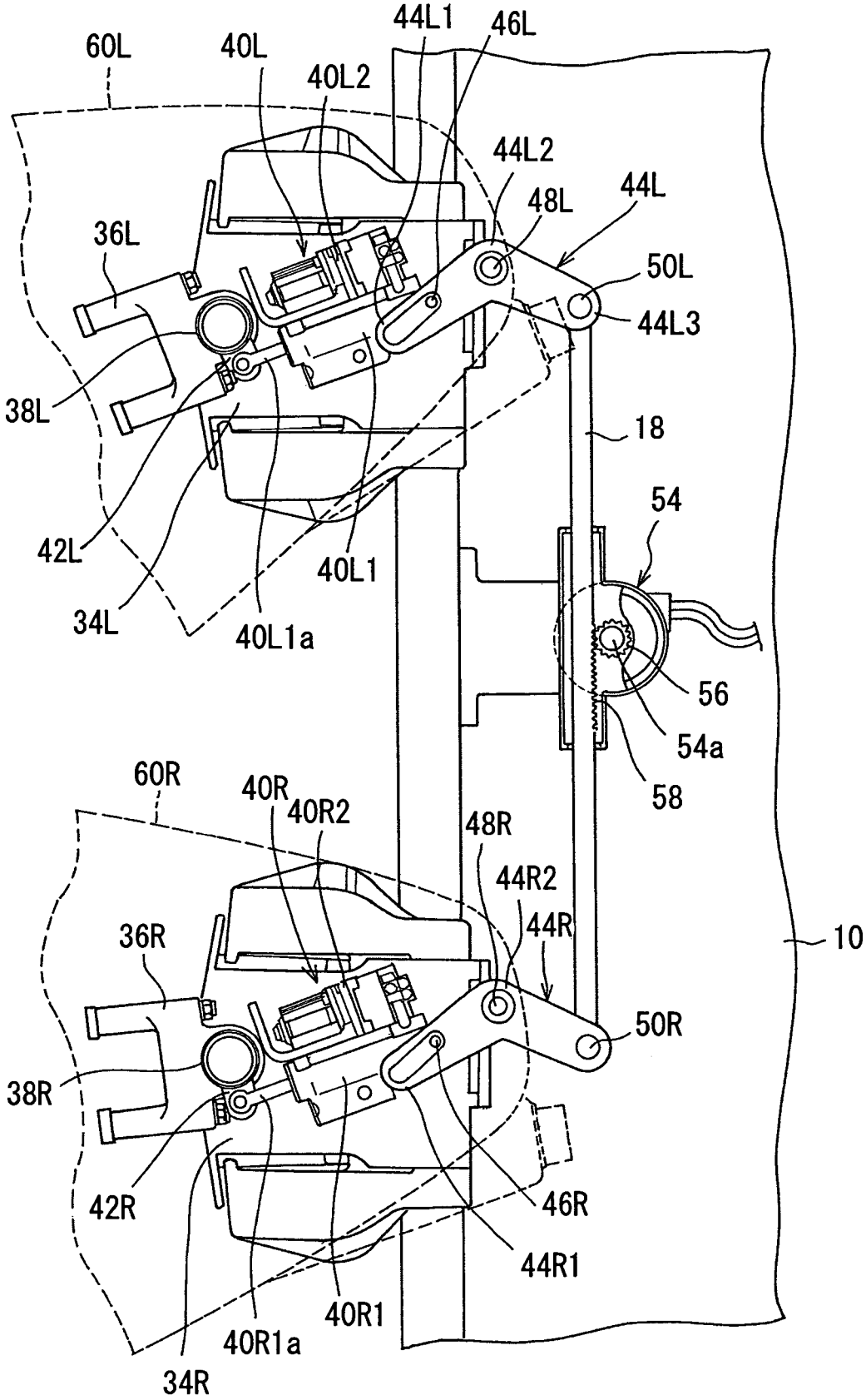
FIG. 14 is a plan view similar to FIG. 3 showing the region around the swivel cases of the starboard and port outboard motors shown in FIG. 1 as viewed from the top.

FIG. 13 is an explanatory view similar to FIG. 11 showing the relative angle between the starboard outboard motor 12R and port outboard motor 12L. FIG. 14 is a plan view similar to FIG. 3 showing the region around the swivel cases 34R, 34L of the starboard and port outboard motors 12R, 12L as viewed from the top. FIGS. 13 and 14 show the starboard and port outboard motors 12R, 12L when the rotation angle θsw is equal to or less than −180 degrees. Accordingly the desired regulation steering angle θdra is made 0.8 degree and θdla 0 degree.

As shown in FIGS. 13 and 14, the setting of θdra to 0.8 degree steers the starboard outboard motor 12R clockwise by the outboard motor actuator 40R. On the other hand, the setting of θdla to 0 degree holds the port outboard motor 12L with no operation by the outboard motor actuator 40L. As a result, as shown in FIG. 13, the extension 86Re of the propeller shaft 86R of the starboard outboard motor and the extension 86Le of the propeller shaft 86L of the port outboard motor are made to intersect rearward of the outboard motors 12R, 12L in the traveling direction, as viewed from the top. In other words, as indicated by θdr+θdra and θdl+θdla in FIG. 10, the steering angle of the outboard motor on the opposite side from the turning direction of the boat 10 (the outside outboard motor) is made larger in absolute value. This condition is referred to as "toe-out" and the difference at this time is referred to as the "toe-out angle." The toe-out angle is exaggerated in FIGS. 13 and 14 to make it easy to recognize.

The explanation of FIG. 9 will be resumed. When the result in S116 is NO, i.e., it is determined that turn of the boat 10 is relatively small, the program goes to S120, in which the desired regulation steering angles θdra, θdla are fixed (set) to 0 degree.

When the result in S102 is NO, i.e., it is determined that the shift (gear) position is reverse (or neutral), or when the result in S108 is NO, i.e., it is determined that the engine speed NEr is less than the predetermined value a (the boat 10 speed is less than medium), the program goes to S120. Next, in S112 and S114, the aforesaid processing is conducted. As a result, the relative angle between the starboard outboard motor 12R and the port outboard motor 12L is not regulated by the outboard motor actuators 40R, 40L, i.e., the toe-in or toe-out is eliminated.

As stated above, the embodiment is configured to have a system for controlling steering of a plurality of outboard motors (12R, 12L) each mounted on a stern of a boat (10) to be steerable by an outboard motor actuator (40R, 40L) relative to the boat and each having an internal combustion engine (62R, 62L) and a propeller (16R, 16L) powered by the engine to propel the boat, comprising: a tie bar (18) interconnecting the outboard motors; a tie-bar actuator (tie-bar motor; 54) adapted to drive the tie bar; a rotation angle sensor (112) adapted to detect a rotation angle of a steering wheel (24) installed at a cockpit of the boat; a tie-bar actuator controller (ECU 124*a*, S10 to S18) adapted to control operation of the tie-bar actuator based on the detected rotation angle of the steering wheel.

The system further includes a crank angle sensor (120R, 120L) adapted to detect speed of the engine (NEr, NEl); and an outboard motor actuator controller (ECU 124*b*, S100 to S114) adapted to control operation of the outboard motor actuators based on at least one of the detected rotation angle of the steering wheel and the detected engine speed.

The system further includes a sensor (116R, 116L) adapted to detect shift position of the outboard motors; and the outboard motor actuator controller (ECU 124, S100 to S114) controls operation of the outboard motor actuators based on the detected rotation angle of the steering wheel, the detected engine speed and the shift positions.

In the system, the outboard motor actuator controller controls the operation of the outboard motor actuators such that extensions of propeller shafts of the propellers of the outboard motors intersect forward of the outboard motors in traveling direction, when an absolute value of the detected rotation angle of the steering wheel is equal to or greater than a predetermined value (b; e.g., 180 degrees).

In the system, the outboard motor actuator controller controls the operation of the outboard motor actuator such that the extensions of propeller shafts of the propellers of the outboard motors intersect forward of the outboard motors in traveling direction, when the detected engine speed is equal to or greater than a predetermined value (a; e.g., 2000 rpm).

In the system, the tie-bar actuator controller determines desired steering angles (θdr, θdl) of the outboard motors based on the detected rotation angle of the steering wheel, and controls the operation of the tie-bar actuator such that errors between the desired steering angles and detected steering angles is eliminated.

In the system, the desired steering angles are determined to be a same value.

It should be noted in the above that, although the foregoing explanation is made with regard to the case where two outboard motors are mounted on the boat 10, the number of motors can instead be three or more.

It should also be noted that, although it is explained that the desired regulation steering angles θdra, θdla are set based on the engine speed NEr of the starboard outboard motor, they can instead be set based on the engine speed NEl of the port outboard motor or the average of NEr and NEl.

It should further be noted that the values of the desired steering angles θdr, θdl and the desired regulation steering angles θdra, θdla are not limited to those set out in the foregoing but can be appropriately determined in accordance with the size, specifications and the like of the outboard motors and boat.

It should further be noted that, although hydraulic cylinders were exemplified for use as the outboard motor actuators 40R, 40L, it is possible instead to utilize electric motors or any of various other kinds of actuators. Also, although an electric motor was taken as an example of the tie-bar actuator 54, a hydraulic cylinder or any other kinds of actuators may be used.

Japanese Patent Application No. 2005-276145 filed on Sep. 22, 2005, is incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. In a boat of the type having a plurality of outboard motors mounted thereon, the improvement comprising a system for controlling steering of the plurality of outboard motors, each mounted on a stern of the boat and each having an internal combustion engine and a propeller powered by the engine to propel the boat, said system comprising:

a rigid, fixed-length tie bar interconnecting the outboard motors;

a tie-bar actuator adapted to drive the fixed-length tie bar;

a rotation angle sensor adapted to detect a rotation angle of a steering wheel installed at a cockpit of the boat; and a tie-bar actuator controller adapted to control operation of the tie-bar actuator based on the detected rotation angle of the steering wheel;

wherein each of said outboard motors is configured to be independently steerable by an outboard motor actuator relative to the boat.

2. The system according to claim 1, further including:

a crank angle sensor adapted to detect speed of the engine; and an outboard motor actuator controller adapted to control operation of the outboard motor actuators based on at least one of the detected rotation angle of the steering wheel and the detected engine speed.

3. The system according to claim 2, further including:

a sensor adapted to detect shift position of the outboard motors; and the outboard motor actuator controller controls operation of the outboard motor actuators based on the detected rotation angle of the steering wheel, the detected engine speed and the shift positions.

4. The system according to claim 2, wherein the outboard motor actuator controller controls the operation of the outboard motor actuators such that extensions of propeller shafts of the propellers of the outboard motors intersect forward of the outboard motors in traveling direction, when an absolute value of the detected rotation angle of the steering wheel is equal to or greater than a predetermined value.

5. The system according to claim 2, wherein the outboard motor actuator controller controls the operation of the outboard motor actuator such that the extensions of propeller shafts of the propellers of the outboard motors intersect forward of the outboard motors in traveling direction, when the detected engine speed is equal to or greater than a predetermined value.

6. The system according to claim 1, wherein the tie-bar actuator controller determines desired steering angles of the outboard motors based on the detected rotation angle of the steering wheel, and controls the operation of the tie-bar actuator such that errors between the desired steering angles and detected steering angles are eliminated.

7. The system according to claim 6, wherein the desired steering angles are determined to be a same value.

8. In a boat of the type having a hollow boat body and a plurality of outboard motors mounted thereon, the improvement comprising a steering control system for controlling steering of the plurality of outboard motors, each of said outboard motors having an internal combustion engine and a propeller powered by the engine to propel the boat, said system comprising:

an outboard motor actuator for each of said outboard motors, each of said outboard motor actuators being independently operable to adjustably control an orientation of the associated outboard motor relative to the boat;

a rigid, fixed-length tie bar interconnecting the outboard motors;

a tie-bar actuator adapted to drive the tie bar;

a rotation angle sensor adapted to detect a rotation angle of a steering wheel installed at a cockpit of the boat; and a tie-bar actuator controller adapted to electronically control operation of the tie-bar actuator to synchronously steer the outboard motors, based on the detected rotation angle of the steering wheel.

* * * * *